US010274145B2

(12) United States Patent
Franceschina

(10) Patent No.: US 10,274,145 B2
(45) Date of Patent: Apr. 30, 2019

(54) MINI LIGHT MACHINE SYSTEMS

(71) Applicant: Karen Sue Franceschina, Marie (CA)

(72) Inventor: Karen Sue Franceschina, Marie (CA)

( * ) Notice: Subject to any disclaimer, the term of this patent is extended or adjusted under 35 U.S.C. 154(b) by 371 days.

(21) Appl. No.: 15/216,671

(22) Filed: Jul. 21, 2016

(65) Prior Publication Data

US 2018/0023772 A1 Jan. 25, 2018

(51) Int. Cl.

| | |
|---|---|
| ***F21S 4/10*** | (2016.01) |
| ***H01J 9/00*** | (2006.01) |
| *F21W 121/00* | (2006.01) |

(52) U.S. Cl.
CPC *F21S 4/10* (2016.01); *H01J 9/00* (2013.01); *F21W 2121/00* (2013.01)

(58) Field of Classification Search
CPC ..... F21S 4/10; H01J 9/00
See application file for complete search history.

(56) References Cited

U.S. PATENT DOCUMENTS

| | | | | |
|---|---|---|---|---|
| 4,244,014 | A * | 1/1981 | Van Ess | F21V 21/0832 362/249.01 |
| 4,335,422 | A * | 6/1982 | Van Ess | F21S 4/10 362/249.01 |
| 4,821,158 | A * | 4/1989 | Mitten | F21S 4/20 362/125 |
| 5,954,419 | A * | 9/1999 | D'Angelo | F21S 4/20 362/125 |
| 6,827,379 | B2 * | 12/2004 | Hill | A47F 5/0006 248/205.3 |
| 8,555,749 | B2 | 10/2013 | Gatski | |
| 9,056,393 | B1 | 6/2015 | Gary et al. | |
| 9,070,544 | B1 | 6/2015 | Shaps | |
| 2013/0333197 | A1 * | 12/2013 | Schulte | B25J 1/04 29/525.08 |

FOREIGN PATENT DOCUMENTS

| | | |
|---|---|---|
| CA | 2049134 | 2/1993 |

* cited by examiner

*Primary Examiner* — Daniel McNally
(74) *Attorney, Agent, or Firm* — Integrity Patent Group, PLC; Charles E. Runyan

(57) ABSTRACT

A mini light machine system for evenly distributing a light strand along a window frame and adhering the light strand to a window with easy peel tape. The mini light machine system has a mini light machine assembly. The mini light machine assembly has a placing machine for placing and adhering a light strand and a light box container for condensed loading and storage of a light strand. In the preferred embodiment the mini light machine assembly is self-propelled and automatically places a light strand in repeatable distances between the individual lights. The mini light machine assembly adheres to a vertical window surface allowing lights to be placed in hard to reach places. Intelligent control is used to cease operation when the mini light machine assembly reaches the end of a window frame. The mini light machine assembly contains a battery thus eliminating the need for power chords.

20 Claims, 5 Drawing Sheets

MINI LIGHT MACHINE SYSTEMS

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of tools and more specifically relates to auxiliary devices for hanging lights.

2. Description of Related Art

Displaying decorative lights is a manner by which to celebrate various occurrences and holidays. Decorative lights are often hung in windows for both internal and external viewing. It is desirable to hang light strands in a secure and uniform manner with the ability to easily remove them. Hanging lights from windows can pose a challenge in terms of adherence methods as well as for accessibility especially for the elderly and those with limited movement. Therefore a suitable solution is desired.

Several attempts have been made to solve the above-mentioned problems such as those found in U.S. Pat. No. 9,070,544 to Shaps and Neal, U.S. Pat. No. 8,555,749 to Gatski, U.S. Pat. No. 6,827,379 Hill, et al., and U.S. Pat. No. 9,056,393 Gary et al., and Canadian Pat No. CA 2,049,134 to Bassaris. This art is representative of auxiliary devices for cleaning, placing, hanging, or removing lights. However, none of the above inventions and patents, taken either singly or in combination, is seen to describe the invention as claimed.

BRIEF SUMMARY OF THE INVENTION

In view of the foregoing disadvantages inherent in the known tools art, the present invention provides a novel mini light machine system. The general purpose of the present disclosure, which will be described subsequently in greater detail is to provide a device for uniformly placing and adhering a light strand to a window.

A mini light machine system is disclosed herein, in a preferred embodiment, comprising a mini light machine assembly further comprising a placing machine and a light box container. In the preferred embodiment, the placing machine adheres to a window and automatically dispenses a light strand that is bonded to the window in a uniform fashion with easy peel tape that sticks the light strand to the window. Easy peel tape offers the advantage of easy removal of the light strand. The placing machine and said light box container are structured and arranged together in combination for providing a means by which to uniformly place a strand of lights along a window frame and adhere the strand of lights to a window with the easy peel tape.

The placing machine further comprises at least two first coupling mechanisms and a first power connection for connecting to the light box container. The placing machine is self-propelled by an electrically powered assembly in combination with a drive assembly comprised of at least three wide alignment wheels thus providing the advantage of uniformly placing a light strand along a window. Automated self-propelled operation offers a further advantage of accessing places that are difficult to reach. Additionally, a window wiper assembly cleans the window for improved adherence of the mini light machine assembly as well as the easy peel tape. The placing machine includes a handle for adhering and removing the mini light machine assembly. The light strand is placed by a light strand dispensing mechanism that is internal to the placing machine while automatically adhering a light strand using a tape dispensing assembly and a tape placement assembly. Both the placing machine and light box container are powered by a power source that is connected to the electrical assembly with a switch. A roll of easy peel tape is secured in the placing machine with a mounting fixture. The placing machine includes a light strand entrance aperture for a light strand to enter the device and a combination light strand and tape placement aperture so a light strand can exit the device for uniform placement along a window as well as adhering the light strand to the window. The placing machine also has a catcher pocket for storing spent backing from the easy peel tape.

In the preferred embodiment, the handle comprises a display window and a switch. The display window comprises an indice of footage covered by the placing machine which further indicates the length of the dispersed portion of a light strand. The electrically powered assembly comprises a motor for the purpose of driving a light dispensing mechanism, a drive assembly, a tape dispensing assembly, and a tape placing assembly. The drive assembly comprises at least three wide alignment wheels that propel the placing machine along a window. The at least three wide alignment wheels comprise adhering suction cups for sticking to a vertical window surface.

The preferred embodiment includes a light box container that comprises at least two second coupling mechanisms and a second a power connection. The light box container is removably coupleable to the placing machine. The light box container includes a light strand exit aperture as an exit point for a light strand. The light box container has a flip down door and a light box lid in order to access an inner volume for loading a light strand. The light box container further comprises a guide assembly and light tray. The guide assembly comprises a plurality of guides that further comprise a tension release lever, a plurality of light strand clips, and a movable clip track that provide the advantage of loading and retaining light strands in a condensed fashion. The light tray comprises an inner volume and a plastic slip cover for further retaining light strands. The flip down door enables the plurality of light guides to slide out of the light box container in a drawer like fashion for ease of loading a light strand. Certain embodiments may not have a light box.

The electrically powered assembly comprises intelligence for propelling the mini light machine assembly around the interior of a window frame. The intelligence and a position sensor work together in functional combination for detecting the end of a window frame and gathering data as to the distance covered and length of light strand dispersed. The intelligence is further used for establishing the placement distance between individual lights along a light strand as well as providing a means for accommodating plugs on multiple light strands. The intelligence works in conjunction with the guide assembly to automatically adjust the light strand spacing to accommodate for the presence of plugs in multiple light strands thus providing the advantage of an evenly place light strand. The plurality of light strand clips are a means for aligning the light strand for dispersing through the light strand exit aperture. The dual purpose tension release lever provides a means to compress the plurality of light strand clips when in one position while providing a means to guide a light strand when in a second position.

In the preferred embodiment the power source is a battery. The intelligence ceases self-propelled motion when the position sensor indicates the mini light machine assembly has reached the end of a window frame. Alternate embodiments use manual power and position control when dispersing a light strand.

The present invention holds significant improvements and serves as a mini light machine system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, mini light machine system, constructed and operative according to the teachings of the present invention.

The various embodiments of the present disclosure will hereinafter be described in conjunction with the appended drawings, wherein like designations denote like elements.

DETAILED DESCRIPTION

Preferably, a mini light machine system should provide means to uniformly place and adhere a light strand to a window and, yet would operate reliably and be manufactured at a modest expense. Thus, a need exists for a reliable mini light machine system to avoid the above-mentioned problems.

As discussed above, embodiments of the present invention relate to tools and more particularly to a mini light machine system as used to improve the ability to uniformly adhere a light strand to a window.

Generally speaking, a mini light machine system may comprise a mini light machine assembly further comprising a placing machine and a light box container. Mini light machine system is structured and arranged to provide a means by which to evenly place a light strand along a window while using a window frame as a guide, and applying easy peel tape for adherence of the light strand to the window.

Figure 1:
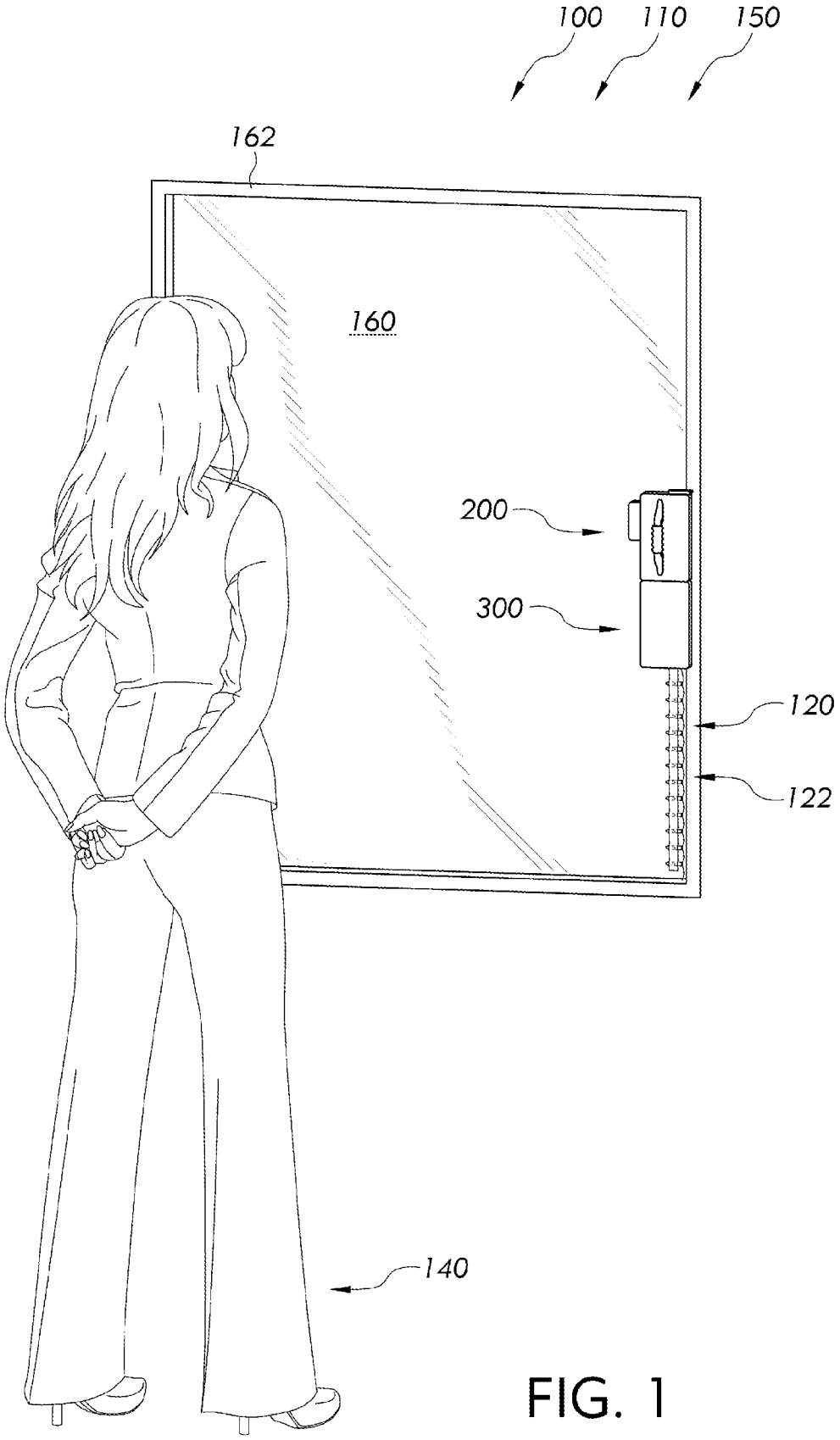
FIG. 1 shows a top perspective view illustrating a mini light machine system during an 'in-use' condition showing mini light machine assembly according to an embodiment of the present disclosure.

Referring to the drawings by numerals of reference, there is shown in FIG. 1, mini light machine system 100 comprises a mini light machine assembly 110 which further comprises a placing machine 200 and a light box container 300 that work together in functional combination. FIG. 1 shows the mini light machine system 100 in an 'in-use' condition 150 by user 140. Mini light machine assembly 110 is shown traversing window frame 162 in a self-propelled manner to evenly adhere light strand 122 to window 160, while securing light strand 122 with easy peel tape 120.

Figure 2:
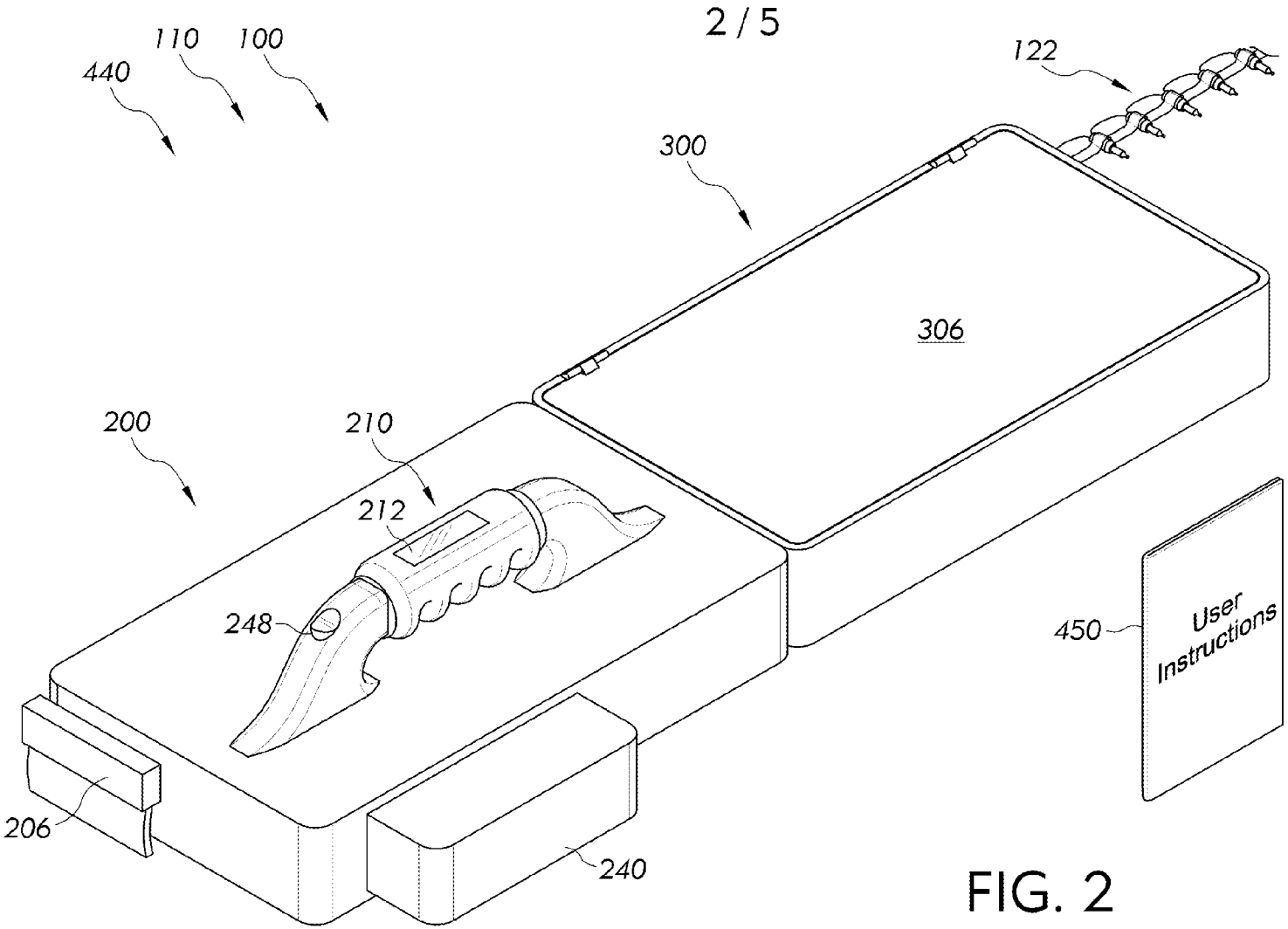
FIG. 2 is a top perspective view illustrating the mini light machine system of FIG. 1, according to an embodiment of the present disclosure.
Figure 3:
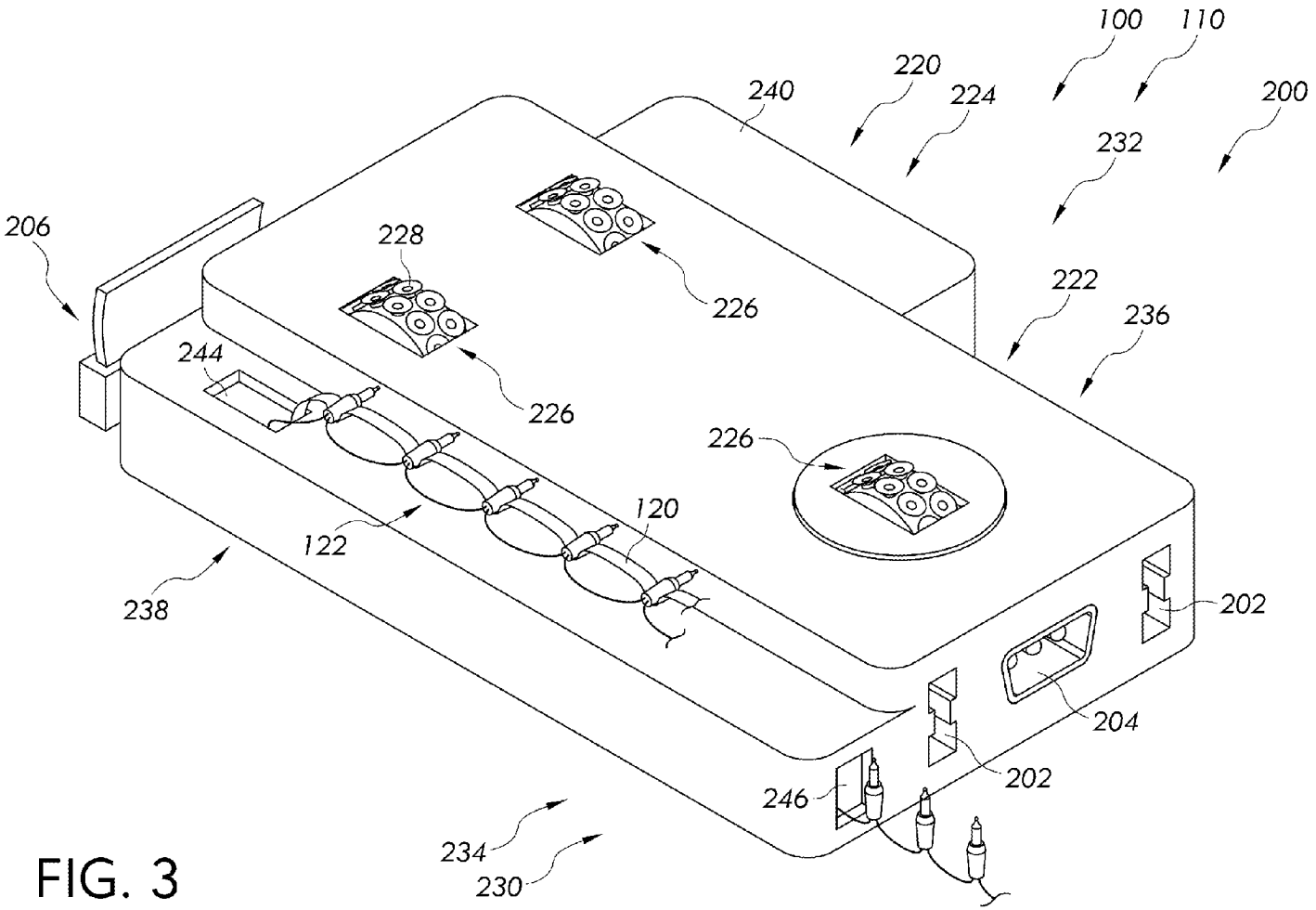
FIG. 3 is a bottom perspective view illustrating a mini light machine assembly of FIGS. 1-2, according to an embodiment of the present disclosure.

Referring now to FIG. 2, mini light machine assembly 110 is illustrated including placing machine 200 and light box container 300. Placing machine 200 provides a means by which to evenly disperse light strand 122 using drive assembly 224 (FIG. 3), electrically powered assembly 220 (FIG. 3), and light strand dispensing mechanism 230 (FIG. 3). Mini light machine assembly 110 automatically adheres light strand 122 to window 160 (FIG. 1) using tape dispensing assembly 232 and tape placement assembly 234.

Referring now to FIG. 3 showing a bottom view of placing machine 200. Placing machine 200 includes an electrically powered assembly 220 which powers drive assembly 224 for automated movement of mini light machine assembly 110. Drive assembly 224 is comprised of at least three wide alignment wheels 226 that are further comprised of adhering suction cups 228 for gripping window 160 (FIG. 1). At least three wide alignment wheels 226 provide a means by which to propel mini light machine assembly 110 along window frame 162 (FIG. 1). Electrically powered assembly 220 is further comprised of motor 222 for driving drive assembly 224 and powering tape dispensing assembly 232, tape placement assembly 234, and light strand dispensing mechanism 230.

Light strand 122 is placed along the window 160 through combination light strand and tape placement aperture 244. Light strand 122 exits light box container 300 (FIG. 4) through light strand exit aperture 326 (FIG. 4) and enters placing machine 200 through light strand entrance aperture 246. Tape placement assembly 234 automatically places easy peel tape 120 over light strand 122. Power source 236 provides power to electrically powered assembly 220 and light box container 300. In the preferred embodiment, power source 236 is a battery. In the alternate embodiments, power source 236 can be via an external power cable or alternative forms of internal portable power sources.

In the preferred embodiment at least two first coupling mechanisms 202 on placing machine 200 are removably couplable to at least two second coupling mechanisms 302 (FIG. 4) on light box container 300 for the purpose of combining placing machine 200 and light box container 300 into single mini light machine assembly 110 that stores as well as disperses light strand 122 and easy peel tape 120. In alternate embodiments, placing machine 200 can be configured to accept a manual insertion of light strand 122 while functioning independent of light box container 300.

In the preferred embodiment, first power connection 204 on placing machine 200 connects to second power connection 304 (FIG. 4) on light box container 300 for the purpose of providing power to light box container 300. Removable easy peel tape 120 is contained in roll form via mounting fixture 238. Dispensed easy peel tape 120 backing is contained in catcher pocket 240. Window wiper assembly 206 cleans window 160 of debris and moisture such that easy peel tape 120 will adhere more securely.

Referring back to FIG. 2, placing machine 200 further comprises handle 210. In preferred embodiments handle 210 contains a switch 248 for powering the mini light machine assembly 110. Switch 248 connects power from power source 236 (FIG. 3) to electrically powered assembly 220 (FIG. 3) to activate self-propelled mode.

Electrical intelligence combined with position sensors determine position for placing individual lights of light strand 122 at intervals as well as determining distance covered and sensing the end of window frame 162 (FIG. 1). The sensed information is used to update indice of footage in addition to automatically ceasing operation when encountering the end of window frame 162.

In alternate embodiments handle 210 contains display window 212 for indicating the length of dispersed light strand 122 via indice of footage. Handle 210 is useful for adhering mini light machine assembly 110 to window 160 (FIG. 1) and then removing mini light machine assembly 110 from window 160.

An alternate embodiment may be void of electrical powered assembly 220, and therefore may comprise a fully mechanical drive arrangement whereas handle 210 is used to manually move mini light machine assembly 110 while at least three wide alignment wheels 226 provide mechanical power to the drive assembly 224, tape dispensing assembly 232, tape placement assembly 234, light strand dispensing mechanism 230, and guide assembly 310. Alternate embodiments of mini light machine assembly 110 may include a yellow warning light as a means for indicating a low volume of easy peel tape 120 roll. Alternate embodiments of mini light machine assembly 110 may also include a red warning light as a means for indicating a low volume of light strand 122. In the preferred embodiment, easy peel tape 120 is dispensed as one continuous strand. In alternate embodiments, easy peel tape 120 may be dispensed in segments.

Figure 4:
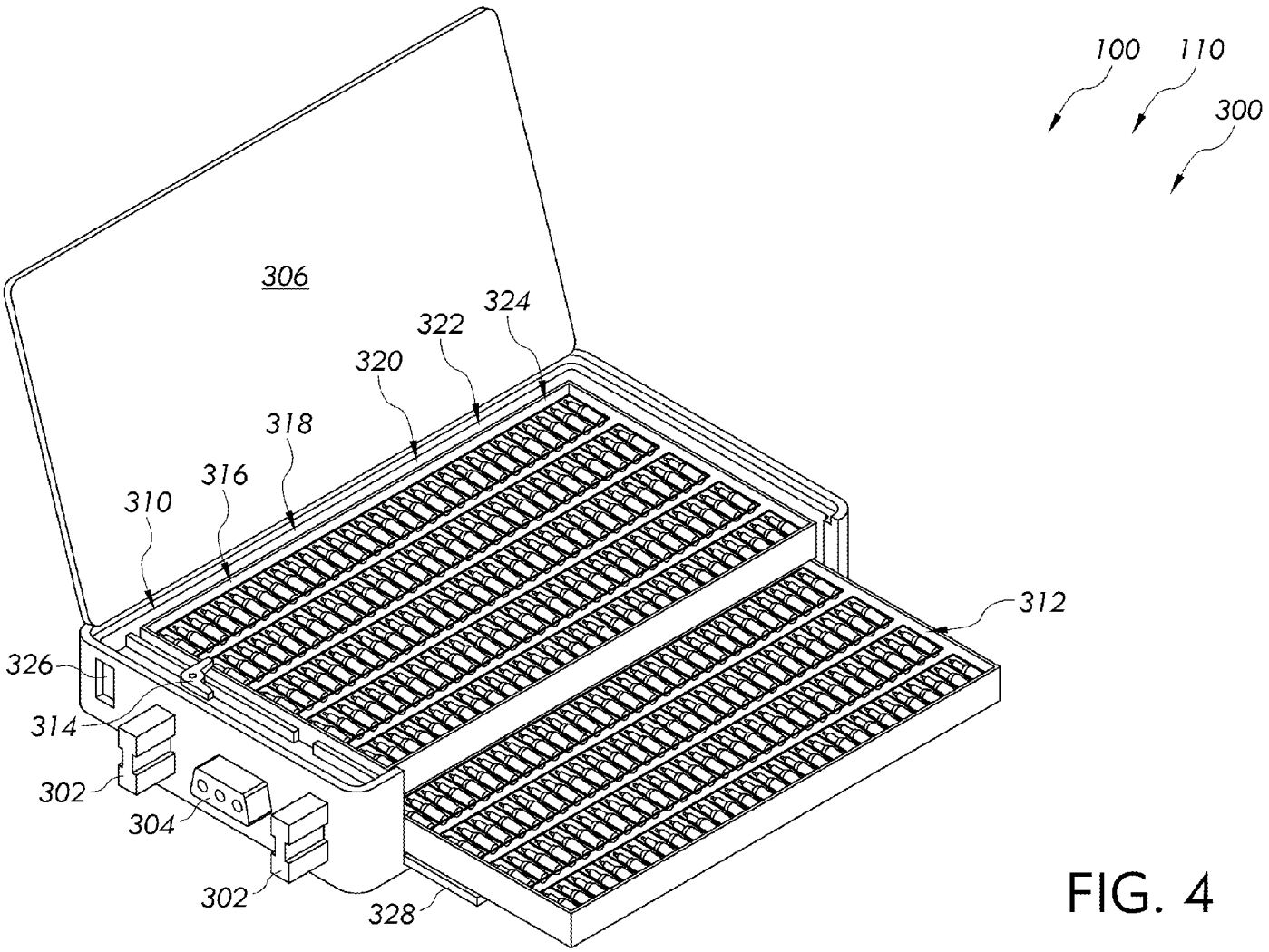
FIG. 4 is a perspective view illustrating the mini light machine assembly of FIGS. 1-3, according to an embodiment of the present disclosure.

Referring now to FIG. 4, mini light machine assembly 110 includes light box container 300 for the purpose of inserting and containing light strand 122 in light tray 320. Light tray 320 further comprises plastic slip cover 324, inner volume 322, and plurality of light strand clips 316, for the purpose of staging light strand 122 for dispersion via placing machine 200. Light box container 300 further comprises guide assembly 310 which automatically disperses light strand 122 via plurality of guides 312. Plurality of guides 312 include tension release lever 314, plurality of light strand clips 316, and movable clip track 318 that work together in functional combination for the purpose of providing an organized method of arranging light strand 122 in light tray 320.

Tension release lever 314 performs a dual function. When in a first position tension release lever 314 assists in guiding light strand 122 during operation. When arranged in a second position tension release lever 314 serves as a means of pressuring and closely aligning light strand clips 316 in a manner that allows more room for user 140 (FIG. 1) to insert light strand 122. Light strand clips 316 also provide a means by which light strand 122 can be wrapped uniformly within light tray 320. In the preferred embodiment, user 140 slides guide assembly 310 out through flip down door 328 for loading light strand 122. In alternate embodiments, user 140 opens light box lid 306 to insert light strand 122 into light box container 300. User 140 then closes light box lid 306 in order to contain light strand 122 within the mini light machine assembly 110 to complete the loading process.

In the preferred embodiment, light box container 300 provides a means for accommodating electrical plugs on light strands 122. Also in the preferred embodiment, guide assembly 310 automatically adjusts light strand 122 spacing to accommodate for the presence of electrical plugs in light strands 122. In alternate embodiments, the spacing between individual lights is user adjustable.

In alternate embodiments a premade light tray assembly in the form of a cartridge containing a uniformly placed light strand 122 may be used in place of an independent light strand 122. The premade light assembly may consist of multiple light strands 122 containing less than one hundred lights, one hundred lights, or more than one hundred lights of a single color or multiple colors. In alternate embodiments a premade assembly may be sold separately from the mini light machine system 100.

It should be noted that mini light machine system 100 may be sold as kit 440 comprising the following parts: at least one mini light machine system 100 and at least one set of user instructions 450. The kit 440 has instructions 450 such that functional relationships are detailed in relation to the structure of the invention (such that the invention can be used, maintained, or the like in a preferred manner). Mini light machine system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
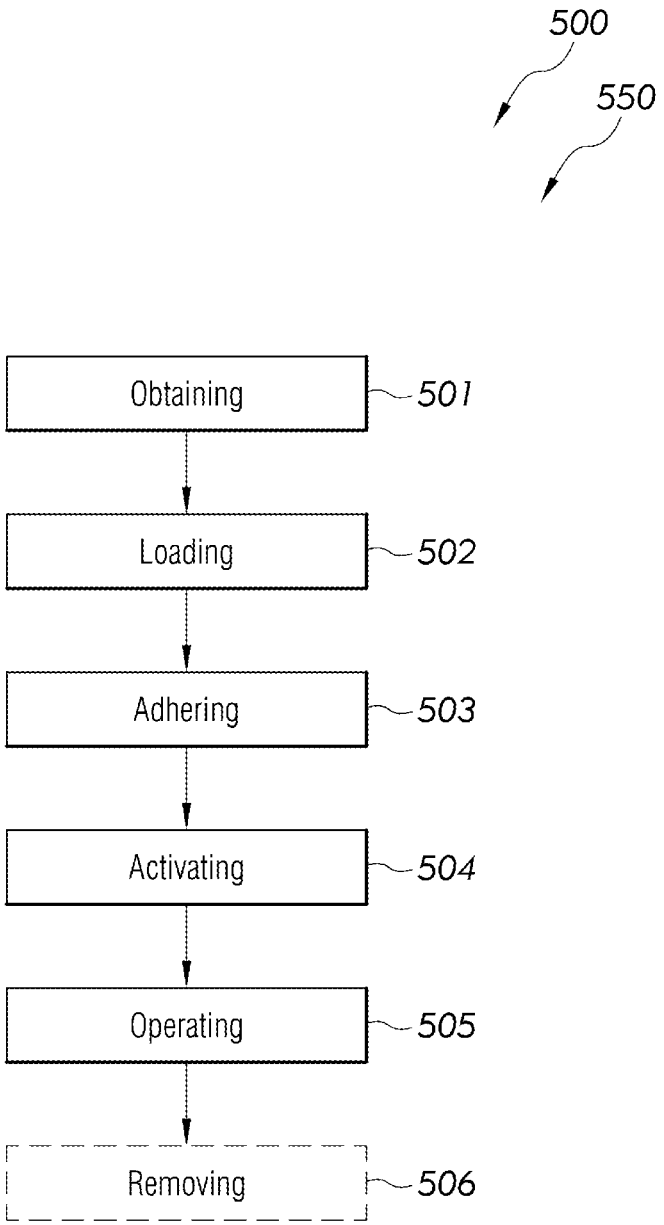
FIG. 5 is a flowchart illustrating a method of use for the mini light machine system of FIGS. 1-4, according to an embodiment of the present disclosure.

Referring now to FIG. 5 showing flowchart 550 illustrating method of use 500 for mini light machine system 100 according to an embodiment of the present invention of FIGS. 1-4. As shown, method of use 500 may comprise the steps of: step one 501, obtaining or providing a system for placing a strand of lights (mini light machine system 100); step two 502, loading a mini light machine assembly 110; step three 503, adhering a mini light machine assembly 110 to a window 160; step four 504, activating a mini light machine assembly 110; step five 505, operating a mini light machine assembly 110; and step six 506, removing a mini light machine assembly 110. It should be noted that step six 506 is an optional step and may not be implemented in all cases. Optional steps of method of use 500 are illustrated using dotted lines in FIG. 5 so as to distinguish them from the other steps of method of use 500.

It should be noted that the steps described in the method of use can be carried out in many different orders according to user preference. The use of "step of" should not be interpreted as "step for", in the claims herein and is not intended to invoke the provisions of 35 U.S.C. §112(f). Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A system for placing a strand of lights, the system comprising:

a placing machine including together in functional combination
- at least two first coupling mechanisms,
- a first power connection,
- a window wiper assembly,
- a handle,
- an electrically powered assembly,
- a light strand dispensing mechanism,
- a tape dispensing assembly,
- a tape placement assembly,
- a power source,
- a mounting fixture,
- a combination light strand and tape placement aperture,
- a light strand entrance aperture, and
- a catcher pocket; and a light box container including together in functional combination
- at least two second coupling mechanisms,
- a second power connection,
- a light box lid,
- a guide assembly,
- a light strand exit aperture,
- a flip down door, and
- a light tray;

wherein said placing machine and said light box container together in functional combination; and wherein said placing machine and said light box container are structured and arranged together in combination to provide a means by which to adhere said strand of lights to a window via an installed easy peel tape roll.

2. The system of claim 1, wherein said light tray is a premade light tray assembly that includes said strand of lights, and is configured to provide a means for automated loading of the at least one of said strand of lights.

3. The system of claim 2, wherein said premade light tray assembly configured as an independent, replaceable element of the system.

4. The system of claim 2, wherein said wherein said strand of lights includes approximately one hundred individual lights.

5. The system of claim 2, wherein said strand of lights includes less than one hundred individual lights.

6. The system of claim 2, wherein said strand of lights includes more than one hundred individual lights.

7. The system of claim 2, wherein said wherein said strand of lights are of a single color.

8. The system of claim 2, wherein said wherein said strand of lights are of a plurality of colors.

9. The system of claim 1, wherein said electrically powered assembly includes a position sensor.

10. The system assembly of claim 9, wherein said position sensor is configured to provide information regarding a distance between lights.

11. The system assembly of claim 10, wherein said distance between lights is displayed as an indice of space on said handle in a display window.

12. The system assembly of claim 11, wherein said distance between lights is user-adjustable.

13. The system of claim 1, wherein said power source is a battery.

14. The system of claim 1, wherein said handle configured to manually power said system.

15. The system of claim 1, wherein said placing machine further includes a yellow warning light configured to indicate a low volume of said tape roll.

16. The system of claim 1, wherein said placing machine further includes a red warning light configured to indicate a low volume of said strand of lights.

17. A system for placing a strand of lights, the system comprising:

a placing machine including together in functional combination
- at least two first coupling mechanisms,
- a first power connection,
- a window wiper assembly,
- a handle,
- an electrically powered assembly,
- a light strand dispensing mechanism,
- a tape dispensing assembly,
- a tape placement assembly,
- a power source,
- a mounting fixture,
- a combination light strand and tape placement aperture,
- a light strand entrance aperture, and
- a catcher pocket; and a light box container including together in functional combination
- at least two second coupling mechanisms,
- a second power connection,
- a light box lid,
- a guide assembly,
- a light strand exit aperture,
- a flip down door, and
- a light tray;

wherein said placing machine and said light box container together in functional combination;

wherein said placing machine and said light box container are structured and arranged together in combination to provide a means by which to adhere said strand of lights to a window via an installed easy peel tape roll;

wherein said power source is a battery;

wherein said electrically powered assembly includes a position sensor configured to provide information regarding a distance between lights, said distance between lights being displayed as an indice of space on said handle in a display window, said distance between lights is user-selectable;

wherein said handle configured to manually power said system;

wherein said light tray is a premade light tray assembly that includes said strand of lights, and is configured to provide a means for automated loading of the at least one of said strand of lights, said premade light tray assembly configured as an independent, replaceable element of the system;

wherein said placing machine further includes a yellow warning light configured to indicate a low volume of said tape roll;

wherein said placing machine further includes a red warning light configured to indicate a low volume of said strand of lights; and wherein said wherein said strand of lights includes approximately one hundred individual lights.

18. The system of claim 17, further comprising a set of instructions; and wherein the placing machine, the light box container, and the set of instructions are arranged as a kit.

19. A method of using a system for placing a strand of lights, the method comprising the steps of:

providing the system for placing the strand of lights;

loading the system for placing the strand of lights with at least one light strand;

adhering the system for placing the strand of lights to a window;

activating the system for placing the strand of lights by turning on a switch; and operating the system for placing the strand of lights.

20. The method of claim 19, further comprising the step of:

removing the system for placing the strand of lights from the window.

* * * * *